US008141383B2

(12) United States Patent
Heyl et al.

(10) Patent No.: US 8,141,383 B2
(45) Date of Patent: Mar. 27, 2012

(54) ENGINE-MACHINE AND EXPANDER HEAT EXCHANGER UNIT

(75) Inventors: Peter Heyl, Cologne (DE); Peter Kuhn, Weinheim (DE); Frank Obrist, Lauterach (AT)

(73) Assignee: Visteon Global Technologies, Inc., Van Buren Twp., MI (US)

( * ) Notice: Subject to any disclaimer, the term of this patent is extended or adjusted under 35 U.S.C. 154(b) by 937 days.

(21) Appl. No.: 12/144,757

(22) Filed: Jun. 24, 2008

(65) Prior Publication Data

US 2008/0314078 A1 Dec. 25, 2008

(30) Foreign Application Priority Data

Jun. 25, 2007 (DE) ..... 10 2007 029 523

(51) Int. Cl.
*F25B 41/00* (2006.01)

(52) U.S. Cl. ..... 62/513; 62/498; 62/509

(58) Field of Classification Search ..... 62/401, 62/513, 515, 501, 498
See application file for complete search history.

(56) References Cited

U.S. PATENT DOCUMENTS 6,000,465 A * 12/1999 Kawahara ..... 165/132
6,044,900 A * 4/2000 Kawahara ..... 165/110
6,250,103 B1 * 6/2001 Watanabe et al. ..... 62/509

* cited by examiner

*Primary Examiner* — Melvin Jones
(74) *Attorney, Agent, or Firm* — Fraser Clemens Martin & Miller LLC; J. Douglas Miller

(57) ABSTRACT

A heat exchanger unit is disclosed, the heat exchanger unit including a first tube element unit, a second tube element unit, and an engine machine apparatus having an expansion step unit and a compression step unit. Each of the tube element units is adapted to condition a fluid flowing therethrough. Desirably, the fluid is compressed in the compression step unit and expanded in the expansion step unit in such a manner that technical operation is transferred from the expansion step unit to the compression step unit so that an inner recovery of energy is made possible.

20 Claims, 8 Drawing Sheets

ENGINE-MACHINE AND EXPANDER HEAT EXCHANGER UNIT

CROSS-REFERENCE TO RELATED APPLICATION

This application claims priority to German Patent Application No. 10 2007 029 523.7, filed Jun. 25, 2007, the entire disclosure of which is hereby incorporated herein by reference.

FIELD OF THE INVENTION

The invention relates to an expander heat exchanger unit for conditioning a first fluid. More particularly, an expander heat exchanger unit for conditioning a cooling agent of an air conditioning unit including a first tube element and a second tube element.

BACKGROUND OF THE INVENTION

The invention relates to an expander heat exchanger unit for conditioning a first fluid, especially a cooling agent of an air conditioning unit, with a heat exchanger, comprising a first tube element unit designed so that the first fluid can flow through it, as well as comprising a second tube element unit designed so that the first fluid can flow through it, in which a transfer of the first fluid from the heat exchanger via an intermediate outlet can be achieved and a transfer of the first fluid can be achieved via an intermediate inlet from the compression step unit to the heat exchanger, and in which an outlet connection distributor for removing the first fluid from the second tube element unit is provided via which the first fluid can be transferred to an expansion step unit.

The invention furthermore relates to a machine or an engine machine apparatus that serves in particular to expand a first fluid and is provided in particular with an expansion step unit that comprises for its part an inner expansion step wheel as well as an outer expansion step wheel that delimit a workspace between curved contact surfaces, in which a first movable support element is associated with the inner expansion step wheel and with the outer expansion step wheel which element is pressed on its front side against the inner expansion step wheel as well as against the outer expansion step wheel.

A disadvantage of the expander heat exchanger unit as described above is that an expansion of the first fluid as well as a heat transfer cannot be achieved with especially high efficiency under different operating conditions. Furthermore, a disadvantage of the machine as described above is that improving efficiency in at least a broad operating range is limited and the machine cannot be used in the aforementioned expander heat exchanger unit. In particular, adapting the engine machine apparatus to different operating conditions with the simplest possible means is problematic.

It would be desirable to develop an expander heat exchanger unit including a first tube element unit through which the first fluid can flow coupled to a second tube element unit designed so that the first fluid can flow through it. A transfer of the first fluid can be achieved here via an intermediate outlet from the heat exchanger to a compression step unit, and a transfer of the first fluid via an intermediate inlet from the compression step unit to the heat exchanger, and an outlet connection distributor is provided for removing the first fluid from the second tube element unit via which the first fluid can be transferred to an expansion step unit, and which compression step unit and expansion step unit are arranged in a cylindrical space volume whose diameter is 10% to 90%, especially 20% to 70% of its axial length. A first conditioning procedure takes place in a preferred manner here in the first tube element unit in which procedure heat is transferred between the first fluid and air. Subsequently, the first fluid can be compressed in the compression step unit. A second cooling procedure can be realized at an appropriately elevated pressure level inside the second tube element unit in which procedure the first fluid is further cooled down. Correspondingly, different temperature ranges are associated with the first tube element unit and the second tube element unit, which temperature ranges can be adjusted by the supplied temperatures of the air. After having flowed through the second tube element unit the first fluid can be expanded in the expansion step unit in such a manner that technical operation is transferred from the expansion step unit to the compression step unit so that an inner recovery of energy is made possible.

Further, it would be desirable to develop a machine including an adjustable control element associated with the first movable support element, which control element can be adjusted as a function of a parameter that varies during the operation of the expansion step unit and/or of the engine machine apparatus, in particular as a function of a pressure in an inlet conduit and/or in an outlet conduit of the expansion step unit. Influence can be exerted on the position of the first movable support element and the forces on it by adjusting the control element. This results in a self-regulating adaptation of the contact pressure on the expansion step unit. As a result the contact pressure of the first support element can be varied automatically and as a function of the operating state of the expansion step unit so that the expansion step unit can be operated at a favorable efficient operating point by adjusting favorable conditions of friction and power.

It would also be desirable to develop a machine including an adjustable control element designed as a movable piston or pin that can be loaded on a front side with the inlet-side pressure of the expansion step unit and on a rear side with an outlet-side pressure of the expansion step unit. In this manner the pin can be transferred from a first operating position into a second operating position as a function of the pressure conditions on the engine machine apparatus and driven by the first fluid itself. In the second operating position, that is preferably assumed when a certain threshold of the inlet pressure is exceeded, the pin preferably changes an inflow cross section into the expansion step unit so that a power output of the expansion machine is preferably further reduced.

Additionally, it would be desirable to develop a machine including a compression step unit arranged in an expansion step unit which compression step unit is associated with a second movable support element that is pressed on its front side against an inner compression step wheel and/or an outer compression step wheel, and a second adjustable control element is associated with the second movable support element which control element can be adjusted as a function of a parameter that can vary during the operation of the compression step unit and/or of the engine machine apparatus, in particular as a function of a pressure in an inlet conduit and/or in an outlet conduit of the compression step unit. The second adjustable control element influences a contacting force in a preferred manner that acts on the second support element which contacting force transfers the second support element onto the compression step unit. As a result, the contact pressing of the support element can be varied automatically and as a function of the operating state of the compression step unit so that the compression step unit can be operated at a favorable efficient operating point by adjusting favorable conditions of friction and power.

SUMMARY OF THE INVENTION

In concordance with the instant disclosure, this problem is surprisingly solved for this type of connection by a configuration with the features described herein.

In one embodiment, the heat exchanger unit comprises a first tube element unit adapted to convey a first fluid therethrough, wherein one end of the first tube element unit is in fluid communication with an inlet connection distributor, and another end of the first tube element unit is in fluid communication with an intermediate outlet; a second tube element unit disposed adjacent the first tube element unit and adapted to convey the first fluid therethrough, wherein one end of the second tube element unit is in fluid communication with an intermediate inlet, and another end of the second tube element unit is in fluid communication with an outlet connection distributor; and an engine machine apparatus including a compression step unit disposed adjacent an expansion step unit and adapted to convey the first fluid therethrough, wherein one end of the compression step unit is in fluid communication with the intermediate outlet and another end of the compression step unit is in fluid communication with the intermediate inlet, and wherein one end of the expansion step unit is in fluid communication with the outlet connection distributor and another end of the expansion step unit is in fluid communication with a discharge.

In another embodiment, the heat exchanger unit comprises a first tube element unit adapted to convey a first fluid therethrough, wherein one end of the first tube element unit is in fluid communication with an inlet connection distributor and another end of the first tube element unit is in fluid communication with an intermediate outlet; a second tube element unit disposed adjacent the first tube element unit and adapted to convey the first fluid therethrough, wherein one end of the second tube element unit is in fluid communication with an intermediate inlet, and another end of the second tube element unit is in fluid communication with an outlet connection distributor; and an engine machine apparatus adapted to convey the first fluid therethrough, the engine machine apparatus further including: an expansion step unit including an inner expansion step wheel, an outer expansion step wheel, and a first support element, the first support element including a front side adapted to contact the inner expansion step wheel and the outer expansion step wheel, wherein one end of the expansion step unit is in fluid communication with the outlet connection distributor, and another end of the expansion step unit is in fluid communication with a discharge, and wherein at least one pressure chamber communicates with the expansion step unit to form at least one control element for changing a power output of the expansion step unit, the expansion step unit also including a variable expansion chamber adapted for an inner expansion of the first fluid and a variable compression chamber adapted for an inner compression of the first fluid, and a compression step unit disposed adjacent the expansion step unit and including an inner compression step wheel and an outer compression step wheel, wherein one end of the compression step unit is in fluid communication with the intermediate outlet, and another end of the compression step unit is in fluid communication with the intermediate inlet, and wherein the compression step unit cooperates with a second support element which is pressed frontally against at least one of the inner compression step wheel and the outer compression step wheel, the second support element adapted to cooperate with the at least one control element, wherein the at least one control element is adjustable as a function of a parameter that can be varied during an operation of at least one of the expansion step unit and the compression step unit; and wherein each of the inner compression step wheel and the inner expansion step wheel is supported on a shaft to facilitate rotation about a first axis and cooperates with an outer cogging, and each of the outer compression step wheel and the outer expansion step wheel is adapted to surround the respective inner step wheel and cooperate with an inner cogging which engages the outer cogging, the outer step wheels supported on a housing to facilitate rotation about a spaced apart second axis.

In another embodiment, the heating, ventilating, and air conditioning system comprises a collector unit adapted to separate a first fluid; a compressor in fluid communication with the collector unit, the compressor adapted to compress the first fluid; a first heat exchanger unit in fluid communication with the compressor, the first heat exchanger unit including: a first tube element unit adapted to convey the first fluid therethrough, wherein one end of the first tube element unit is in fluid communication with an inlet connection distributor and another end of the first tube element unit is in fluid communication with an intermediate outlet; a second tube element unit disposed adjacent the first tube element unit and adapted to convey the first fluid therethrough, wherein one end of the second tube element unit is in fluid communication with an intermediate inlet, and another end of the second tube element unit is in fluid communication with an outlet connection distributor; and an engine machine apparatus adapted to convey the first fluid therethrough, the engine machine apparatus further including: an expansion step unit and a compression step unit disposed adjacent the expansion step unit, wherein the expansion step unit includes an inner expansion step wheel, an outer expansion step wheel, and a first support element, the first support element including a front side adapted to contact the inner expansion step wheel and the outer expansion step wheel, wherein one end of the expansion step unit is in fluid communication with the outlet connection distributor, and another end of the expansion step unit is in fluid communication with a discharge, and wherein at least one pressure chamber communicates with the expansion step unit to form at least one control element for changing a power output of the expansion step unit, the expansion step unit also including a variable expansion chamber adapted for an inner expansion of the first fluid and a variable compression chamber adapted for an inner compression of the first fluid, and the compression step unit including an inner compression step wheel and an outer compression step wheel, wherein one end of the compression step unit is in fluid communication with the intermediate outlet, and another end of the compression step unit is in fluid communication with the intermediate inlet, and wherein the compression step unit cooperates with a second support element which is pressed frontally against at least one of the inner compression step wheel and the outer compression step wheel, the second support element adapted to cooperate with the at least one control element, wherein each of the inner compression step wheel and the inner expansion step wheel is supported on a shaft to facilitate rotation about a first axis and cooperates with an outer cogging, and each of the outer compression step wheel and the outer expansion step wheel is adapted to surround the respective inner step wheel and cooperate with an inner cogging which engages the outer cogging, the outer step wheels supported on a housing to facilitate rotation about a spaced apart second axis; and a second heat exchanger in fluid communication with the first heat exchanger and the collector unit.

DRAWINGS

The above, as well as other advantages of the present disclosure, will become readily apparent to those skilled in the art from the following detailed description, particularly when considered in the light of the drawings described herein. The drawings show:

Figure 4A:
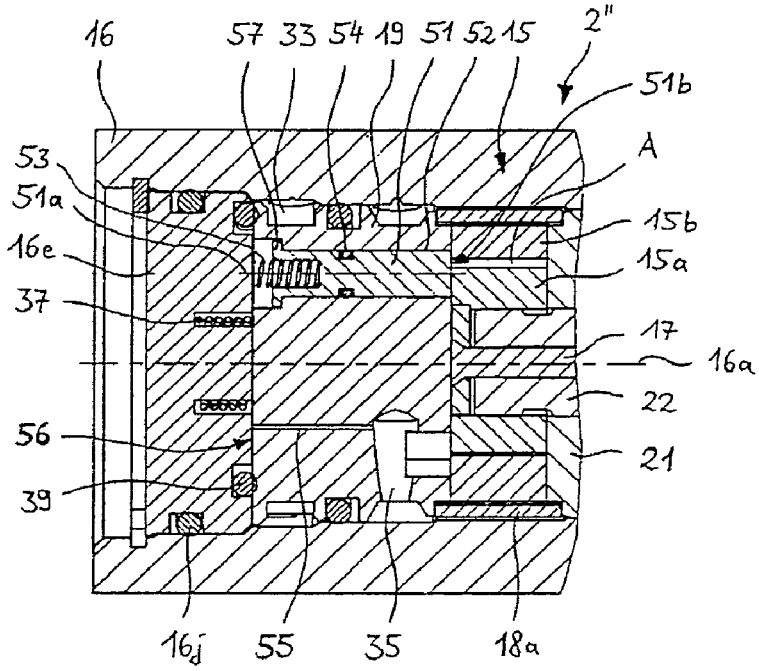
Figure 4B:
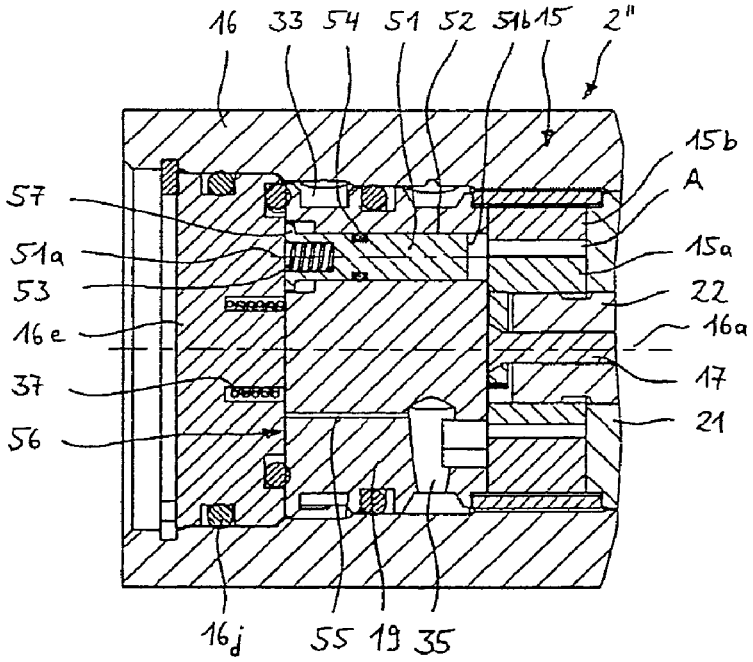
Figure 6A:
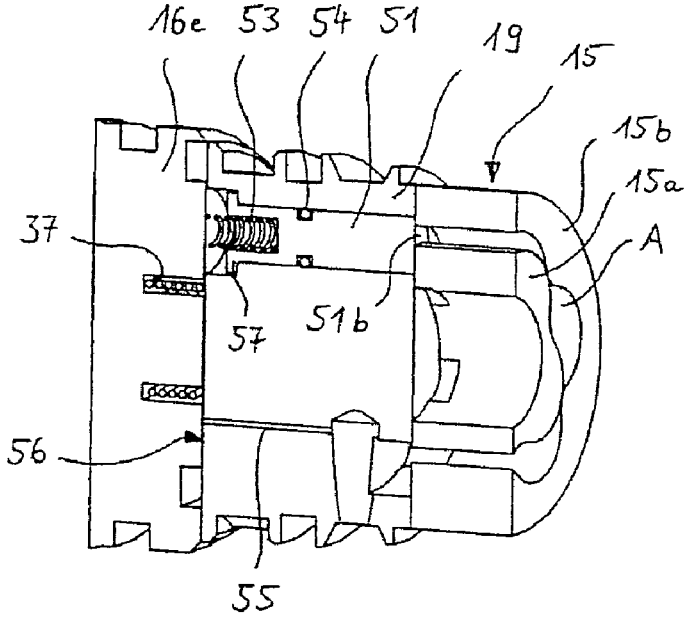
Figure 6B:
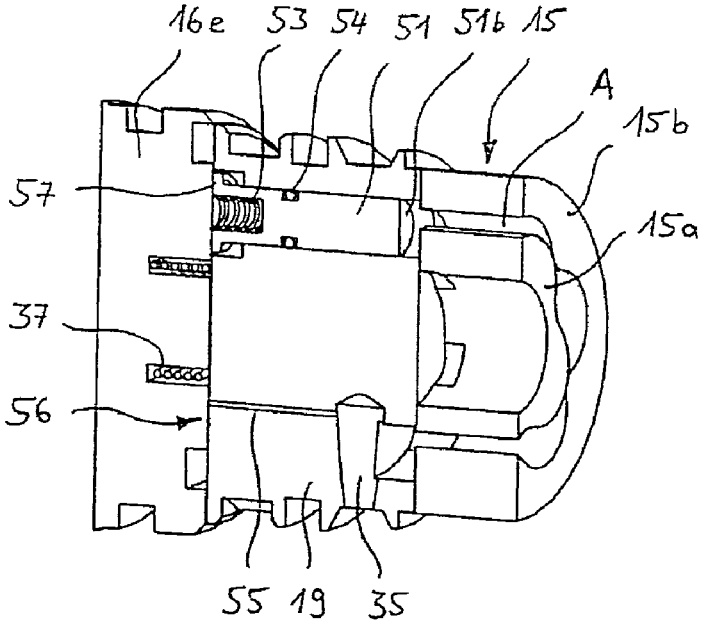
Figure 7:
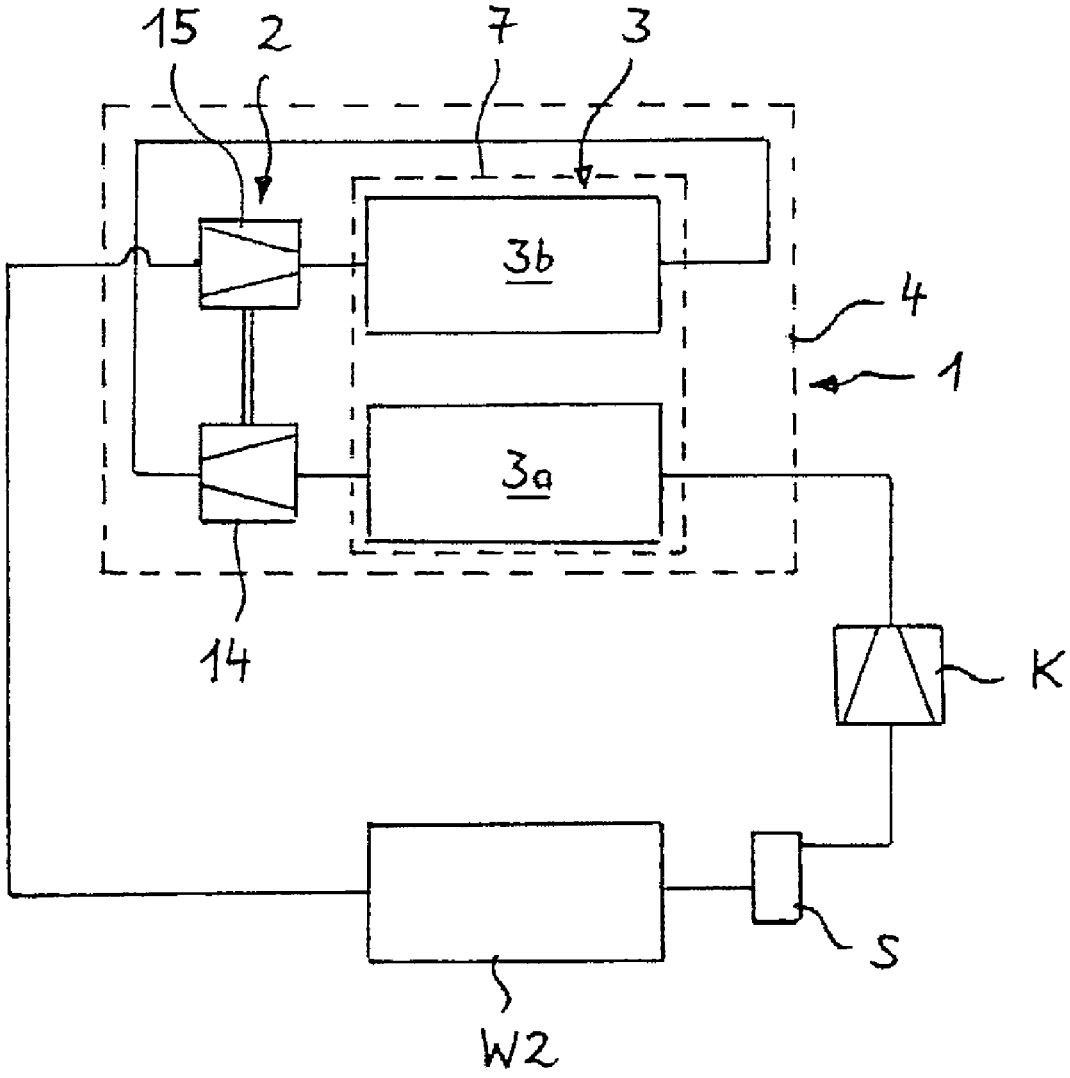

FIGS. 4*a* and 4*b* are longitudinal sectional views of a compression unit of a third expansion step/compression unit at different work points;

FIGS. 5*a*, 5*b*, 5*c*, and 5*d* are schematic cross-sectional views of the compression unit according to FIGS. 4*a* and 4*b* in successive operating situations;

FIGS. 6*a* and 6*b* are side perspective longitudinal sectional views of the compression unit according to FIGS. 4*a* and 4*b*; and FIG. 7 is a schematic view of a cooling agent circuit in an automobile air-conditioning system with the heat exchanger unit comprising an expansion step/compression unit.

DETAILED DESCRIPTION OF THE INVENTION

The following description is merely exemplary in nature and is not intended to limit the present disclosure, application, or uses. It should also be understood that throughout the drawings, corresponding reference numerals indicate like or corresponding parts and features.

In the figures of the drawing, the same structural parts are given the same reference numbers.

Figure 1:
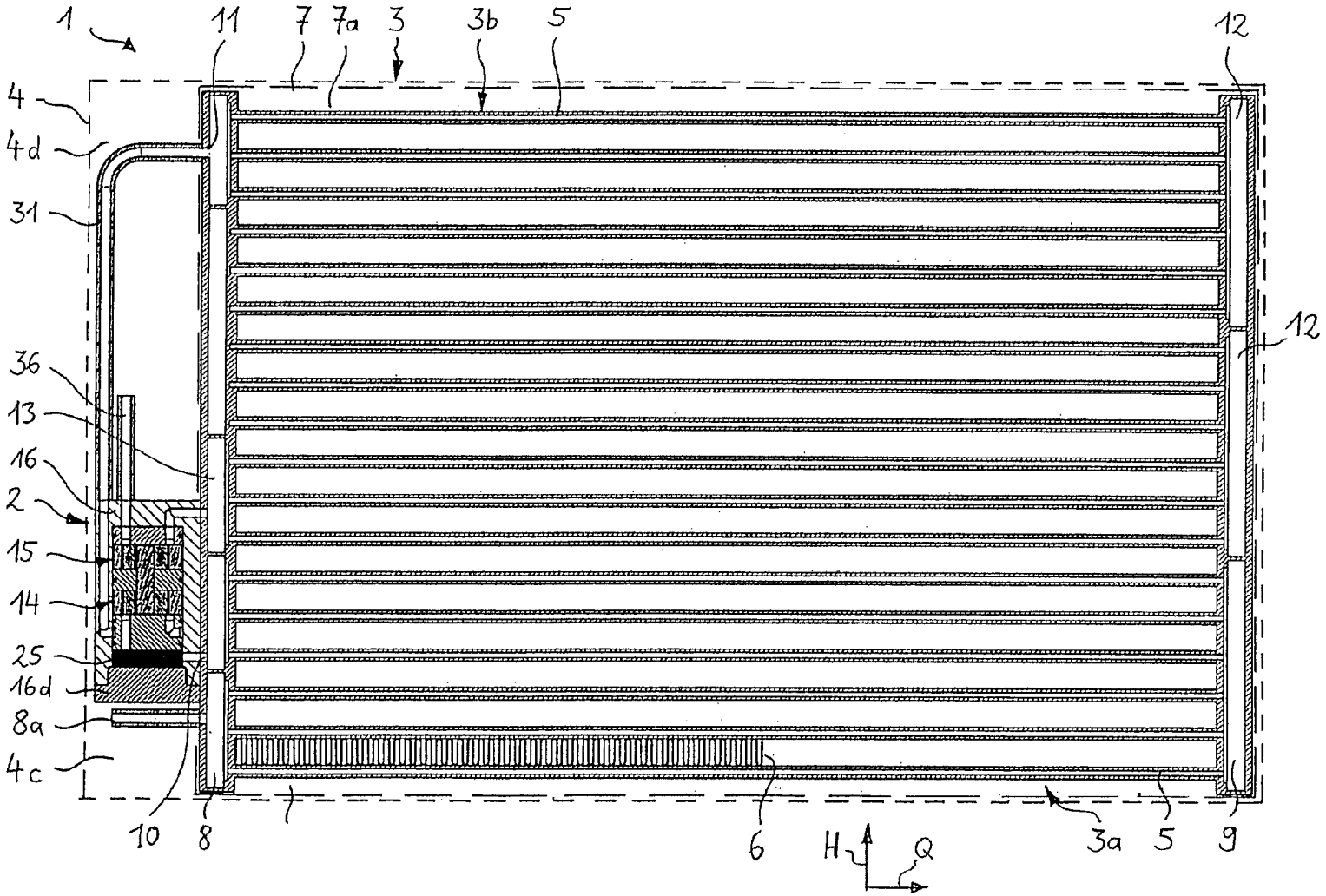
FIG. 1 is a longitudinal sectional view of a heat exchanger unit according to an embodiment of the invention.
Figure 2:
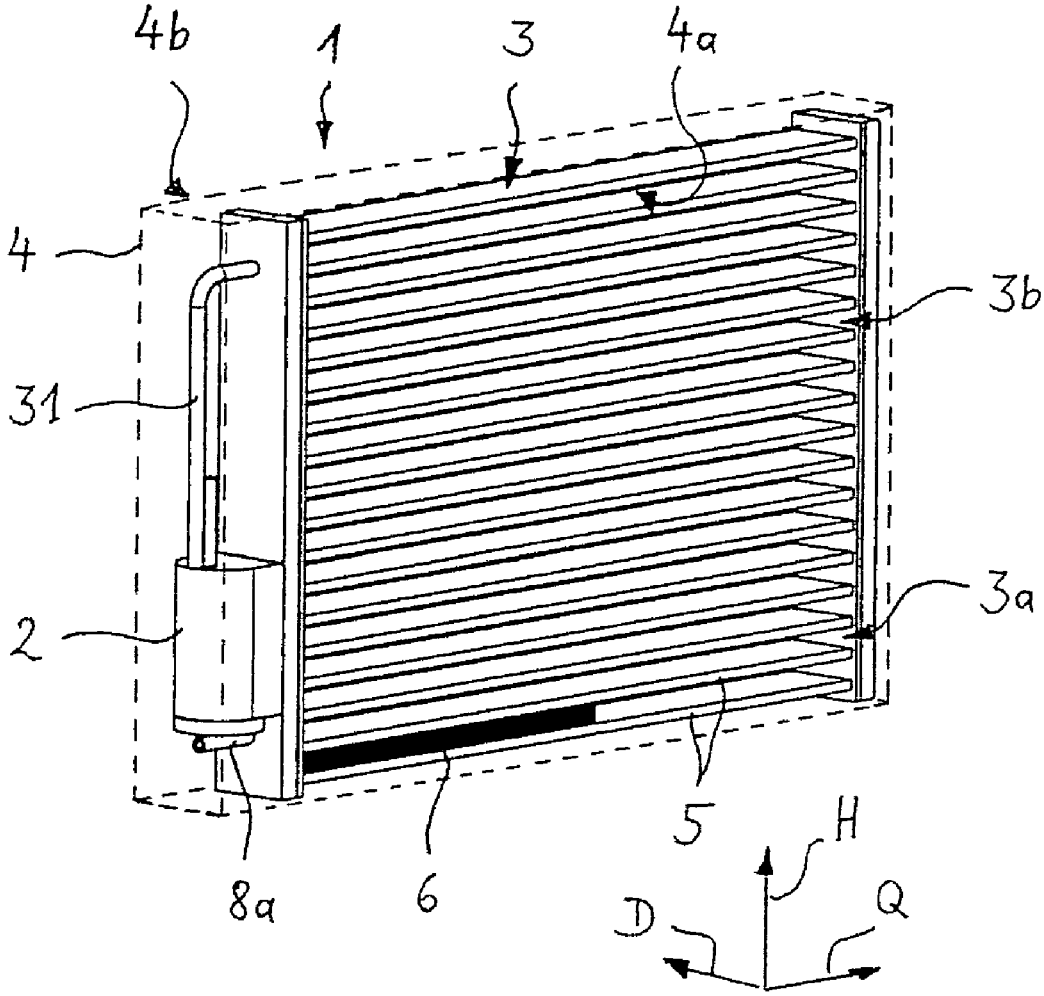
FIG. 2 is a side perspective view of the heat exchanger unit illustrated in FIG. 1.

A heat exchanger unit 1 of an automobile air conditioning system that serves as a so-called expander heat exchanger unit comprises according to FIGS. 1, 2, and 5 a heat exchanger 3 in the form of a fluid-air heat exchanger as well as an engine machine apparatus in the form of a first expansion step/compression unit 2 that are preferably arranged in a common casing volume 4 shaped like a parallelepiped (see FIG. 2). Heat exchanger 1 serves in particular for the exchange of heat between a first fluid and a second fluid in the form of ambient air, and in particular a cooling agent of a cooling agent circuit schematically shown in detail in FIG. 7 and forming part of the air-conditioning system is selected as the first fluid. Furthermore, heat exchanger unit 1 serves for the thermodynamic and energetic conditioning of the first fluid.

A preferred cooling agent circuit comprises in particular a cooling agent compressor K in which gaseous cooling agent is compressed and transported and which is coupled on the discharge side to heat exchanger unit 1 in accordance with the invention. A second heat exchanger W2 is arranged downstream from heat exchanger unit 1 in accordance with the invention and in which liquid cooling agent is evaporated in the framework of a cooling process. A collector unit S (liquid separator) can follow the second heat exchanger W2 in which the liquid cooling agent can be separated from the gaseous cooling agent. Gaseous cooling agent is drawn off from collector unit S and supplied to cooling agent compressor K. Thus, a closed cooling agent circuit with an especially simple construction results. It is understood, of course, that the cooling agent circuit can be operated in both directions and can thus also be operated as a heat pump. Furthermore, is it understood that the first fluid in the form of cooling agent contains a certain amount of lubricant with the aid of which moveable parts in the cooling agent circuit can be lubricated. A lubricant circulation rate of 0.1% to 3.5% is preferred. It is furthermore understood that the cooling agent itself can be used as lubricant for movable parts of the cooling agent circuit.

In a modified exemplary embodiment the heat exchanger unit 1 and/or the expansion step/compression unit 2 can be provided in a cooling agent circuit of a mobile or stationary cooling system and/or of a heat pump. In a further modified exemplary embodiment another gaseous and/or liquid second fluid is provided instead of air for the heat exchanger unit 1. In another modified exemplary embodiment the fluid-air heat exchanger 3 is designed so that it can be flowed through by at least three physically and/or chemically different fluids.

The common casing volume 4 has a comparatively large first front surface 4*a* oriented parallel to a vertical axis H (inclined approximately vertically or up to 30° to the vertical) and parallel to a transverse axis Q of the heat exchanger unit and through which one or several air currents (and optionally a third fluid) can be supplied to the fluid-air heat exchanger 3 in the direction of a flow-through axis D. In a corresponding manner, fluid-air heat exchanger 3 is designed to be permeable for the particular air current in the direction of flow-through axis D. The air currents can be removed from fluid-air heat exchanger 3 on a second front surface 4*b* opposite the first front surface 4*a*.

Fluid-air heat exchanger 3 comprises in accordance with the invention a first tube element unit 3*a* as well is a second tube element 3*b* each comprising a plurality of tube elements 5 aligned in the direction of transverse axis Q. Tube elements 5 are provided for a purposeful guiding of the first fluid primarily in the direction of transverse axis Q and a tube element 5 is designed in particular as a flat tube profile with one or several hollow spaces through which the first fluid can flow. Heat-conducting heat exchange elements 6, e.g., so-called fins, are arranged between individual tube elements 5 in a preferred manner and are fixed in a heat-conducting connection to tube elements 5. In FIGS. 1 and 2 only a part of the heat exchange elements 6 provided between the tube elements 5 is shown for the sake of clarity. Tube elements 5 are designed so that the second and/or third fluid can flow around them, in particular in flow-through direction D.

The first tube element unit 3*a* is arranged directly below the second tube element unit 3*b* inside a parallelepipedic tube element casing volume 7 surrounding the tube element units 3*a*, 3*b*. A first air current is associated in a preferred manner with first tube element unit 3*a* and a second air current with second tube element unit 3*b*, which first air current can have a higher temperature than the second air current. In a modified exemplary embodiment a continuous temperature gradient is provided over the air currents whose lowest temperature level is located in particular in a vertically upper area 7*a* of tube element casing volume 7.

Fluid-air heat exchanger 3 furthermore comprises an inlet connection distributor 8 in a lower area 4*c* to which distributor the first fluid can be supplied via infeed 8*a*. The first fluid can be transferred via inlet connection distributor 8 to first tube element unit 3*a*, which first fluid can be distributed in the area of inlet connection distributor 8 onto a plurality of tube elements 5. Here, tube elements 5 of the first tube element unit 3*a* are preferably connected in such a manner that the flow of the first fluid inside the first tube element unit 3*a* is deflected in the area of a first deflection distributor 9 at least once by 180° and can be conducted out of the first tube element unit 3*a* via an intermediate outlet 10. The first fluid can be transported in the direction of vertical axis H upward to the intermediate outlet 10 via first tube element unit 3*a* which intermediate outlet 10 is arranged approximately above inlet connection distributor 8. Such an arrangement is preferably realizable if the first fluid is present in all operating states in a gaseous state in the first tube element unit 3*a* and can thus be transported upward through the first tube element unit 3*a* in a vertical direction.

Furthermore, fluid-air heat exchanger 3 comprises an intermediate inlet 11 in a vertically upward area 4*d* of common casing volume 4 via which inlet the first fluid can be supplied to the second tube element unit 3*b*. Here tube elements 5 of the second tube element unit 3*b* are preferably connected in such a manner that the flow of the first fluid in the second tube element unit 3*b* can be deflected several times by 180° in the area of several second deflection distributors 12. Finally, the first fluid is conducted via an outlet connection distributor 13 out of second tube element unit 3*b* and thus out of fluid-air heat exchanger 3. Outlet connection distributor 13 is preferably arranged relative to vertical axis H at a level below intermediate inlet 11 so that the first fluid passes a certain geodetic gradient when flowing through second tube element unit 3*b*. In particular, outlet connection distributor 13 is arranged in a lower section of second tube element unit 3*b* and above first tube element unit 3*a*. Different phase compositions of the first fluid can be tolerated via such an arrangement in the fluid-air heat exchanger 3 when flowing through the first tube element unit 3*a* and/or the second tube element unit 3*b*, during which a more or less high liquid phase component can be achieved by condensation.

As already mentioned, an engine machine apparatus in the form of a first expansion step/compression unit 2 according to FIGS. 1 and 2 is associated with fluid-air heat exchanger 3. The first fluid from first tube element unit 3*a* can be supplied to first expansion step/compression unit 2 via intermediate outlet 10, and the second tube element unit 3*b* is connected in after expansion step/compression unit 2. In an especially preferred manner the transfer pipeline between heat exchanger 3 and expansion step unit is designed to be heat-insulated by a poor heat-conducting jacketing or the like.

Figure 3:
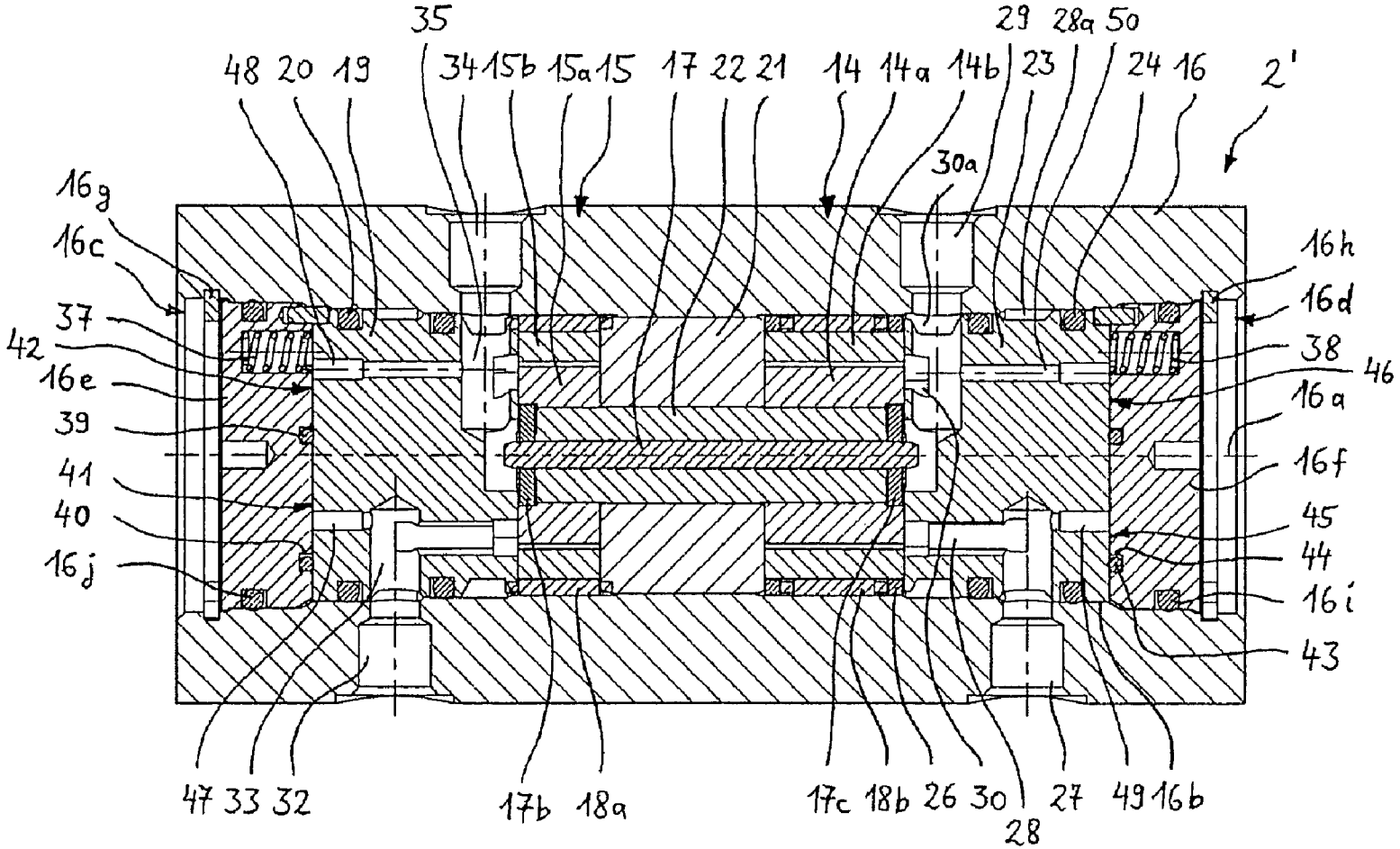
FIG. 3 is a longitudinal sectional view of an engine machine apparatus in the form of a second expansion step/compression unit.

According to FIG. 3 even an engine machine apparatus in the form of a second expansion step/compression unit 2' comprises a compression step unit 14 as well as an expansion step unit 15 (the structural elements that are the same or have the same effect receive the same reference numerals as in the first expansion step/compression unit 2 according to FIGS. 1 and 2.

Compression step unit 14 and expansion step unit 15 are arranged in a common housing 16 that is cylindrical at least in sections (see FIG. 3). Housing 16 preferably has the same width in the direction of flow-through axis D as fluid-air heat exchanger 3. In a modified exemplary embodiment the expansion step unit 15 and the compression step unit 14 are housed in separate housings but arranged adjacent to one another. In another modified exemplary embodiment the expansion step unit 15 and the compression step unit 14 can be coupled to each other in a torque-proof manner via a transmission unit and/or a coupling unit. In particular, a coupling of expansion step unit and compression step unit is provided that can be varied as a function of the operating state of the heat exchanger unit and/or of the automobile air conditioning unit. To this end a regulating apparatus/control apparatus is provided that receives information about the operating state of the automobile air conditioning unit and/or the heat exchanger unit via at least one sensor.

Several conduits for transferring the first fluid are arranged in housing 16 that are described in detail in the following. A substantially cylindrical hollow space 16*b* with a central axis 16*a* is formed in housing 16 in which space a common shaft 17 is eccentrically supported in such a manner that it can rotate about its own axis of rotation. The central axis 16*a* and the axis of rotation of the common shaft 17 have a constant distance from one another. Common shaft 17 is rotatably supported inside a non-rotating hollow axle 22, which hollow axle 22 is inserted substantially immovably in housing 16 via a central, insulating separating wall 21. In a modified exemplary embodiment another machine is coupled to common shaft 17 that is designed in particular as an electric motor unit and/or generator unit. In order to minimize losses and integration of the electric machine into the engine machine apparatus with a through shaft can be provided. Alternatively or additionally a detachable, non-positive or positive coupling can be provided between the electric machine and common shaft 17. In other modified exemplary embodiments other mechanical and/or electrical consumers are coupled to common shaft 17.

On the one hand, an inner expansion step wheel 15*a* is rotatably supported on hollow axle 22. On the other hand an inner compression step wheel 14*a* is supported on hollow axis 22 and two cam arrangements 17*b*, 17*c* make possible a rotation-proof coupling of inner expansion step wheel 15*a*, inner compression step wheel 14*a* and common shaft 17. An outer wheel is associated with the inner expansion step wheel 15*a* and as well as with the inner compression step wheel 14*a*, namely, an outer expansion step wheel 15*b* and an outer compression step wheel 14*b*. An inside cogging is provided on an outer expansion step wheel 15*b* that is engaged with a corresponding outside cogging on inner expansion step wheel 15*a*. Expansion step wheels 15*a*, 15*b* preferably form an inner-axle rotary piston machine with a comb engagement of 5:4. An inner cogging is provided on outer compression step wheel 14*b* that is engaged with a corresponding outer cogging on inner compression step wheel 14*a*. The compression step wheels 14*a*, 14*b* preferably also form an inner-axle rotary piston machine with a comb engagement of 5:4. The inner wheels 14*a*, 15*a* consequently form together with common shaft 17 the so-called power-outputting part of the machine.

It is understood that alternatively even rotary piston machines with a circular engagement or other engagement variants are possible, in which case even other engagement ratios, e.g., 4:3, 8:7 or 6:5, etc. can be provided—in the expansion step unit as well as in the compression step unit. In another modified exemplary embodiment slip engagements (comparable to the conditions in a Wankel motor) can be provided between compression step wheels 14*a*, 14*b* and expansion step wheels 15*a*, 15*b*. In such an instance the outer compression step wheel 14*b* and the expansion step wheel 15*b* would preferably be coupled to one another in a torque-transmitting manner as power rotors.

In preferred exemplary embodiments of the invention a compensation/rotor surface ratio is between 20% and 50%, especially preferably between approximately 30% and 40%. Furthermore, in preferred exemplary embodiments substantially the same profiles and the same coggings are selected for the compression step unit and the expansion step unit, and furthermore, different lengths of the compression step unit and of the expansion step unit are preferably selected.

Outer wheels 14*b*, 15*b* are rotatably supported centrally in common housing 16 about geometric center axis 16*a* and at least one annular roller bearing arrangement and/or friction bearing arrangement 18*a*, 18*b* is/are provided. A plurality of cylindrical or spherical roller elements can be considered as roller bearing arrangement 18*a*, 18*b* that can be held in a common cage. The roller bearing arrangement and/or friction bearing arrangement is preferably associated with a lubricant reservoir and/or a lubricant supply apparatus. In a modified exemplary embodiment complete needle bearings are provided with a preferably closed outer and/or inner ring. In a modified exemplary embodiment a guide shoe is provided in the area of the resulting force on at least one of the outer wheels 14*b*, 15*b* on which shoe the at least one outer wheels 14*b*, 15*b* is supported. A guide shoe can be designed as a separate structural element and has a comparatively small contact surface on which the at least one supported outer wheels 14*b*, 15*b* slides in a contacting manner.

A first housing cover 16*e* is provided in the area of a first front side 16*c* of housing 16 which cover is supported in housing 16 by a ring 16*g* against a shoulder in the axial direction. An annular seal 16*j* can be provided along its outer circumference. A first (mechanical) spiral spring 37 can be inserted with a certain pre-tension in an especially preferable manner in a housing cover in the area of an inner recess or indentation. A different type of spring element, in particular a hydraulic or pneumatic one, can also be used in a known manner. In another preferred manner several spring elements can be arranged symmetrically or uniformly about central axis 16*a* so that a uniform common exertion of the force of the springs results.

A first, preferably metallic or ceramic support element 19 is provided between the elements of expansion step unit 15 on the one hand and the first housing cover 16*e* on the other hand, which element 19 carries at least one circumferential sealing ring 20 along its circumference. The first support element 19 is movably supported in the direction of axis 16*a* and supports inner expansion step wheel 15*a* and outer expansion step wheel 15*b* on the front. First support element 19 is preferably pressed with preferably rather low to moderate force against expansion step wheels 15*a*, 15*b* via spiral spring 37 inserted under pre-tension between the support element 19 and housing cover 16*e*. This conception becomes particularly relevant during the starting procedure of the engine machine apparatus, in which a reliable pressing of support element 19 against the expansion step wheels 15*a*, 15*b* is made possible even at a standstill and during the starting procedure by the pre-tension of spiral spring 37.

A slot whose thickness is, e.g., approximately 0.5% of the diameter of the expansion step unit 15 is provided between the opposing front surfaces of first support element 19 and of first housing cover 16*e*. In alternative exemplary embodiments the rotor/diameter slot ratio is selected to be less than 500:1. A preferably toroidal elastic first ring seal 39 is set into the slot. The first ring seal 39 is optionally associated in particular on sides of the first housing cover 16*e* with a corresponding ring groove 40 that receives at least in sections the first ring seal 39 in the relaxed state and whose volume is sufficient for substantially completely receiving ring seal 39 in a compressed or deformed state. In most of the operating states of the engine machine apparatus first ring seal 39 should be under tension in the axial direction and stand out of annular groove 40 in such a manner that a small first pressure chamber 41 is delimited inside ring seal 39 in the slot between the first housing cover 16*e* and the first support element 19. The first pressure chamber 41 communicates via a first bore 47 with the inlet side of expansion step unit 15. It forms a type of first control element in the form of a pneumatic spring whose pressure is a function of the inlet pressure of the expansion unit.

Furthermore, a small second pressure chamber 42 is formed adjacent to it in the slot between the first housing cover 16*e* and the first support element 19 which volume 42 surrounds first ring seal 39 on the outside and optionally communicates with the receiver of the first spiral spring 37. The second pressure chamber 42 is preferably designed as a thin or extremely thin joint with a thickness less than 1 mm, especially less than 0.5 mm. The thickness of first pressure chamber 41 is preferably identical to the thickness of second pressure chamber 42. The second pressure chamber 42 communicates via a second bore 48 with the outlet side of expansion step unit 15. It forms a type a second control element in the form of a pneumatic spring whose pressure is a function of the outlet pressure of the expansion unit. The first and second control elements are connected in parallel as concerns their technical efficiency to spiral spring 37. In an alternative exemplary embodiment at least two springs are connected in series of which preferably one is constructed as a spiral spring.

Ring groove 40 and first ring seal 39 surround an axial surface in a preferred manner that constitutes 10% to 90% of the front axial surface of cover 16*e*. Ring groove 40 and first ring seal 39 furthermore surround a surface in a preferred manner whose size corresponds approximately to 25% to 85% of the front axial surface taken up by the expansion step unit 15. The (radial) position of first ring seal 39 can be selected centrically or eccentrically to geometric central axis 16*a* as a function of the forces produced in expansion step unit 15. Thus, a surface oriented transversely to axis 16*a* is available for the second pressure chamber 42 whose size can be inversely 90% to 10% of the front axial surface of cover 16*e*.

In a modified exemplary embodiment the inner front axial surface of the first housing cover 16*e* is designed to be set back slightly in the area of the first pressure chamber 41. In another modified exemplary embodiment the ring groove 40 and the first ring seal 39 are designed to be non-circular at least in sections.

Insulating separating wall 21 fixed in housing 16 is provided between expansion step unit 15 and compression step unit 14 on which wall the compression step wheels 14*a*, 14*b* as well as expansion step wheels 15*a*, 15*b* rest in a contacting manner. Insulating separating wall 21 is preferably manufactured from a poorly heat-conductive material, in particular from a plastic or a ceramic material. The insulating separating wall 21 is preferably inserted into the housing 16 with a pressed fit or transition fit. In a modified exemplary embodiment the insulating separating wall 21 is screwed or riveted to the housing 16. Furthermore, the housing 16 is manufactured in a preferred manner at least in sections from a poorly heat-conductive material, especially from a plastic.

A second housing cover 16*f* is provided in the area of a second front side 16*d* of housing 16 with which cover housing 16 can be designed to be closed on the side opposite first cover 16*e*. The second housing cover 16*f* is supported like the first housing cover 16*e* in housing 16 by means of a ring 16*h* against the shoulder in the axial direction. Moreover, an annular seal 16*i* can also be provided on the second housing cover 16*f*. A mechanical spiral spring 38 is inserted with a certain pre-tension in an especially preferred manner in second housing cover 16*f* in the area of an inner recess or indentation. A different type of spring element, in particular a hydraulic or pneumatic one, can also be used in a known manner.

A second support element 23 is provided between second housing cover 16*f* and compression step unit 14 which element makes contact on the front side on the one hand with compression step wheels 14*a*, 14*b* and on the other hand with housing cover 16*f*. The second support element 23 is preferably designed substantially identically or symmetrically to the first support element 19. The second support element 23 is preferably pressed with a slight to moderate force against compression step wheels 14*a*, 14*b* via spiral spring 38 inserted between the support element 23 and housing cover 16*d*. At least one outside sealing ring 24 is associated with the second support element 23 in a circumferential groove.

Another slot whose thickness is, e.g., approximately 0.5% of the diameter of the compression step unit is provided between the opposing front surfaces of the second support element 23 and of the second housing cover 16*f*. In alternative exemplary embodiments the rotor/diameter slot ratio is selected to be less than 500:1. A preferably toroidal elastic second ring seal 43 is inserted in the other slot. Second ring seal 43 is associated in particular on the sides of second housing cover 16*f* with a corresponding second ring groove 44 that receives the second ring seal 43 in sections in the relaxed state and whose volume is sufficient to substantially completely receive ring seal 43 in a compressed or deformed state. In most of the operating states of the engine machine apparatus the second ring seal 43 should be under tension in the axial direction and project out of ring groove 44 in such a manner that a small third pressure chamber 45 is delimited in the space surrounded by ring seal 43 in a slot between second housing cover 16*f* and second support element 23. The third small pressure chamber 45 communicates via a third bore 49 with the outlet side of compression step unit 14. Thus, the third pressure chamber 45 forms a type of third control element in the form of a pneumatic spring whose pressure is a function of the outlet pressure (depending on the operating level) of the compression unit.

Furthermore, a small fourth pressure chamber 46 is formed adjacent to it in the other slot between second housing cover 16*f* and second support element 23, which volume 46 surrounds second ring seal 43 on outside and optionally communicates with the receptacle of second spiral spring 38. The small fourth pressure chamber 46 communicates via a forth bore 50 with the inlet side of compression step unit 14. It forms a type of fourth control element in the form of a pneumatic spring whose pressure is a function of the inlet pressure of the compression step unit.

The second annular groove 44 and the second ring seal 43 surround a surface in a preferred manner that constitutes 10% to 90% of the axial front surface of second cover 16*f*. Furthermore, ring groove 44 and second ring seal 43 preferably surround a surface who size approximately corresponds to 25% to 85% of the axial front surface occupied by wheels 14*a*, 14*b* of compression step unit 14. The (radial) position of second ring seal 43 can be selected centrically or eccentrically to the geometric central axis 16*a* as a function of the forces arising in compression step unit 14. Second ring seal 43 is arranged in a preferred manner with its third pressure chamber 45 substantially symmetrically to the first ring seal 39.

In a modified embodiment the inner axial front surface of second housing cover 16*f* is designed to be slightly set back in the area of third pressure chamber 45. In another modified exemplary embodiment the second ring groove 44 and the second ring seal 43 are designed to be non-circular at least in sections. In another modified exemplary embodiment first ring seal 39 and second ring seal 43 are designed to be substantially the same. In another modified exemplary embodiment the first ring seal 39 and the second ring seal 43 differ as regards their size so that the resulting pressure chambers and/or their axial front surfaces are different.

A substantially cylindrical spatial volume results with the inclusion of insulating separating wall 21 and of support elements 19, 23 which volume is substantially filled out by expansion step unit 15 and compression step unit 14. The diameter of this cylindrical spatial volume is preferably between 10% and 90%, especially between 20% and 70% of its axial length.

During the operation of the engine machine apparatus there are certain (excess) pressures in the four control elements that are functions of the operating state of the machine when the pressure chambers 41, 42, 45, 46 associated with the control elements are loaded with a first fluid. The highest pressures of the engine machine apparatus are located especially preferably in the first pressure chamber 41 and in the first control element and in the third pressure chamber 45 and in the third control element. The pressures in the first pressure chamber 41 and the third pressure chamber 45 preferably correspond to the pressure in a high-pressure side of a cooling agent circuit in accordance with FIG. 7 and are therefore equally large.

The method of operation of the suggested arrangement of the first control element and of the third control element can be represented as follows. The control elements are actuated as a function of the operating state of the engine machine apparatus in that an excess pressure builds up in the cited pressure chambers 41, 45. The control elements act via their front surfaces on the two support elements 19, 23 that are loaded in the axial direction toward the housing center by the control elements. Therefore, these control elements act with their pressure chambers 41, 45 as pneumatic springs whose spring force is a function of the (outlet-side) operating pressures of the engine machine apparatus. The higher the operating pressures are, the greater the force with which the control elements press on the support elements 19, 23. Then, support elements 19, 23 transmit the axial forces further onto the rotating wheels of the expansion step unit 15 and the compression step unit 14. Inversely, the contact pressure is reduced when the operating pressure decreases. Thus, the contact pressure of the support elements 19, 23 of the expansion step unit 15 and the compression step unit 14 is coupled in a self-regulating manner to the operating state of the engine machine apparatus. It is of course understood that such a configuration in accordance with the invention can also be provided for a compression machine operating in isolation or independently or for an expansion machine operating in isolation or independently.

A circumferential spacer ring 26 is arranged between outer wheel 14*b* of the compression step unit 14 and between the housing 16 adjacent to second support element 23 and optionally also assumes sealing functions. The same can be provided between outer wheel 15*b* of the expansion step unit 15 and the housing 16 in order to seal a flowoff conduit of the expansion step unit 15.

In a modified exemplary embodiment the housing covers are riveted or screwed to the housing 16. In a further modification the support elements 19, 23 are associated with at least one axial guide arrangement that prevents in particular a rotary movement of the support elements 19, 23, supports a gliding movement in axial direction and ensures a reliable mounting.

A flowoff conduit 28 of the compression step unit 14 is arranged substantially in second support element 23 and communicates via ring groove 28*a* with a second flowoff conduit 27 of the compression step unit 14, which second flowoff conduit 27 is designed as a bore in the housing 16.

A first inflow conduit 29 of the compression step unit 14 is arranged in the housing 16 approximately diametrically opposite flowoff conduit 27. This first inflow conduit 29 communicates with a second inflow conduit 30 of the compression step unit 14, starting from which compression step wheels 14*a*, 14*b* can be loaded with cooling agent. In addition, an annular conduit 30*a* branches off from the second inflow conduit 30 of the compression step unit 14. The first inflow conduit 29 is preferably directly connected to the intermediate outlet 10 of the fluid-air heat exchanger 3 or constructed in one piece with it. In a modified exemplary embodiment a preferably thermally insulated transfer pipeline is connected in between the intermediate outlet 10 and the first inflow conduit 29. With the aid of the explained piping the first fluid from the fluid-air heat exchanger 3 coming downstream from the intermediate outlet 10 can be fed via the inflow conduits 29, 30 into the compression step unit 14, in which the first fluid is compressed with the aid of intermeshing compression step wheels 14*a*, 14*b*. The first fluid can subsequently be transferred via the flowoff conduits 27, 28 to a transfer pipeline 31 (see FIG. 1) via which the first fluid can be transported to the intermediate inlet 11.

After having flowed through the second tube element unit 3*b* the first fluid arrives via the outlet-connection distributor 13 at a third inflow conduit 32 arranged in housing 16 as well as at a fourth inflow conduit 33 arranged in the first support element 19. The first fluid can be supplied to expansion step unit 15 via the third and fourth inflow conduits 32, 33, in which step 15 it can be continuously expanded under the release of potential energy to expansion step wheels 15*a*, 15*b*. A third flowoff conduit 34 arranged in the housing 16 and a fourth flowoff conduit 35 arranged in the first support element 19 are provided on a side diametrically opposite the inflow conduits 32, 33, which the conduits 34, 35 communicate with the low-pressure side of expansion step unit 15 and make possible a transfer of the expanded first fluid to a discharge 36 (analogous to FIG. 1). The first fluid leaves not only the expansion step/compression unit 2' but also the entire heat exchanger unit 1 via the discharge 36.

FIGS. 4*a* and 4*b* as well as FIGS. 5*a* to 5*d* and FIGS. 6*a* and 6*b* show an engine machine apparatus in the form of a third expansion step/compression unit 2" in accordance with the invention in sections. In particular, an expansion step unit 15 is shown substantially equal to the expansion step unit of the second expansion step/compression unit 2' according to FIG. 3. The structural parts that are the same or act in the same manner therefore again receive the same reference numerals.

As already described for the second expansion step/compression unit 2' according to FIG. 3 (for which reason the description using FIG. 3 can be referred to its full extent) there is a pairing, in a housing 16 of the third expansion step/compression unit 2", of inner expansion step wheel 15*a* and outer expansion step wheel 15*b* that are pressed against a fixed wail 21 by a first support element 19 arranged so that it can be shifted axially. In order to make a contact pressure available a mechanical (or alternatively pneumatic) spring 37 is provided in a central arrangement in a first cover 16*e* permanently positioned in the housing which spring presses against the first support element 19.

In order to make a pressure dependent on the operating level in the area of a slot 56 between first cover 16*e* and first support element 19 a tap bore 55 is provided in support element 19 that establishes a connection between slot 56 and a flowoff conduit 35. Alternatively, a tapping of an inlet conduit of the expansion step unit 15 is provided by the tap bore and optionally a throttle. Thus, a pneumatic spring with minimal lift is formed in slot 56 that functions as first control element. A pressure force can be applied on support element 19 with this control element that can be adjusted during operation of the engine machine apparatus using the present pressure. In particular, the control element can be especially strongly adjusted when the pressure in the flowoff conduit 35 strongly increases. Every adjustment of the control element brings about a change of the pressure force on support element 19 and a change of the contact pressure between support element 19 and the expansion unit. In this connection the term "adjustment" denotes any change of a physically acting property of one of the control elements.

According to FIGS. 5*a* to 5*d* an inflow conduit 33 empties in the area of the contact surfaces between support element 19 and expansion step unit 15 (dotted lines) into work chamber A of the expansion step unit, so that a first fluid can be supplied to expansion step unit 15 via the inflow conduit 33. The first fluid is preferably expanded in expansion step unit 15, during which technical work is performed and can be transferred as rotational energy to a connected compression unit.

A preferably cylindrical pin 51 is arranged offset from the inflow conduit 33 in the circumferential direction adjacent to the inflow conduit 33 in a fifth bore 52. The fifth bore 52 also empties with a slight interval from the inflow conduit 33 into work chamber A of the expansion step unit 15. A longitudinal axis 51*a* of the pin 51 and of the fifth bore 52 is aligned substantially parallel to central axis 16*a* of housing 16. The cylindrical pin 51 is supported in such a manner that it can shift in a sliding manner in the fifth bore 52 and is loaded on one side via a spiral spring 53 pre-tensioned in a first operating state in accordance with FIGS. 4*a* and 6*a*. An outer ring seal 54 surrounding the pin 51 along its jacket is associated with the pin 51 for a seal.

In particular, the fifth bore 52 communicates with the slot 56 so that the cylindrical pin 51 can be loaded on its back side with a pressure dependent on the operating level. Thus a control element in the form of a small pneumatic spring is formed in the area of the fifth bore 52 that loads the cylindrical pin 51 like a piston from a back side. A flange or collar 57 is associated in a preferred manner with the pin 51, as a result of which on the one hand a support on a shoulder in the fifth bore 52 can be achieved, which support acts axially against the spring power. On the other hand an attack surface for the pressure present in the bore 52 is optionally given.

If the pin 51 is in its first operating position shown in FIGS. 4*a* and 6*a* its front surface 51*b* is aligned with the adjacent front surface of support element 19 facing the expansion step wheels 15*a*, 15*b*. In the first operating position the pin 51 closes the fifth bore 52 on its end. The pin 51 is manufactured in a preferred manner from a hardened metal or a ceramic material. A shift path that is approximately the same size or smaller than the diameter of the fifth bore 52 is associated with the cylindrical pin 51 between the first work position shown in FIGS. 4*a* and 6*a* and a second work position shown in FIGS. 4*b* and 6*b*.

As is apparent from FIGS. 5*a* to 5*d* a small overflow conduit 58 extending in the circumferential direction is provided between the fifth bore 52 and the inflow conduit 33 and intersects the bore 52 and the conduit 33 geometrically. The throughput cross section of the small overflow conduit 58 is preferably designed to be smaller than a minimal throughput cross section of the inflow conduit 33. Furthermore, the small overflow conduit 58 is designed to be open on the front surface of the support element 19 facing the expansion step wheels 15*a*, 15*b* so that it can communicate along its entire length with work chamber A. In a modified exemplary embodiment the small overflow conduit 58 is designed to be closed aside from mouths to the fifth bore 52 and to the inflow conduit 33.

Figure 5A:
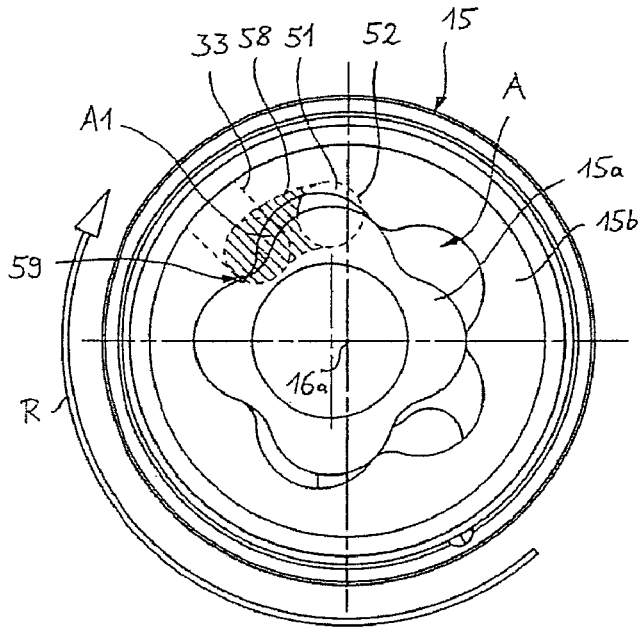
Figure 5B:
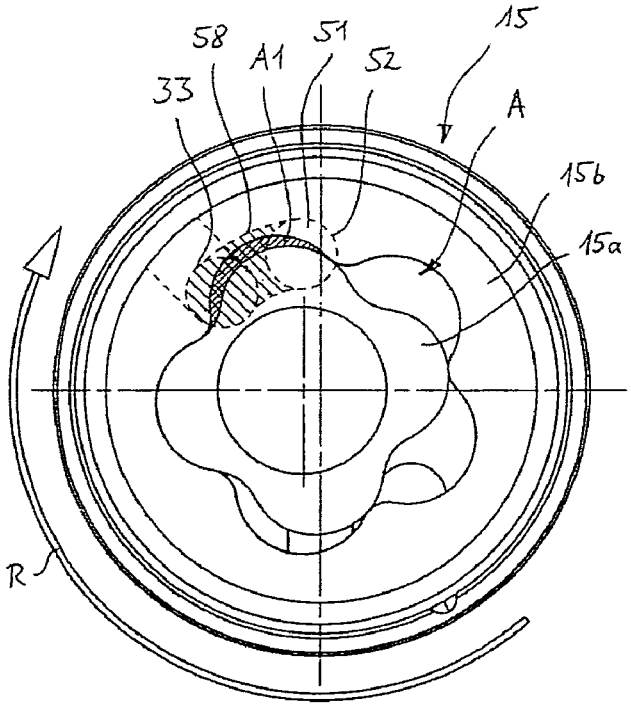
Figure 5C:
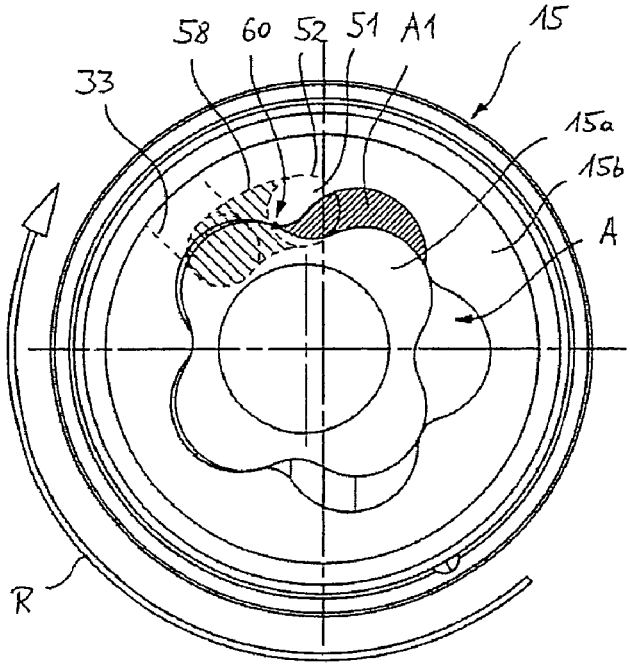

The function of the pin 51 can be described especially using FIGS. 5*a* to 5*d*. According to FIG. 5*a* a first fluid is supplied via the inflow conduit 33 at the beginning of a filling cycle into a first partial work chamber A1 of the expansion step unit 15. The inner expansion step wheel 15*a* and the outer expansion step wheel 15*b* block off the first work chamber A1 on a flank 59. The shaded area of the overflow conduit 58 and of the inflow conduit 33 communicates in such a manner with the partial work chamber A1 that the latter can be filled with the first fluid as is shown in FIG. 5*b* in close shading. The filling phase ends in the position shown in FIG. 5*c* on a flank 60 during a further rotation of the expansion step wheels 15*a*, 15*b* in the direction of arrow R to the extent that the pin 51 is in its first operating position and delimits the overflow conduit 58 in the area of the flank 60 (or of its prolongation). In the position of the expansion step wheels 15*a*, 15*b* shown according to FIG. 5*c* they surround a volume of partial work chamber A1 whose shaded front surface is smaller by a factor of 1.5 to 2, especially 1.77 that a maximally achievable the front surface between the expansion step wheels 15*a*, 15*b*.

Figure 5D:
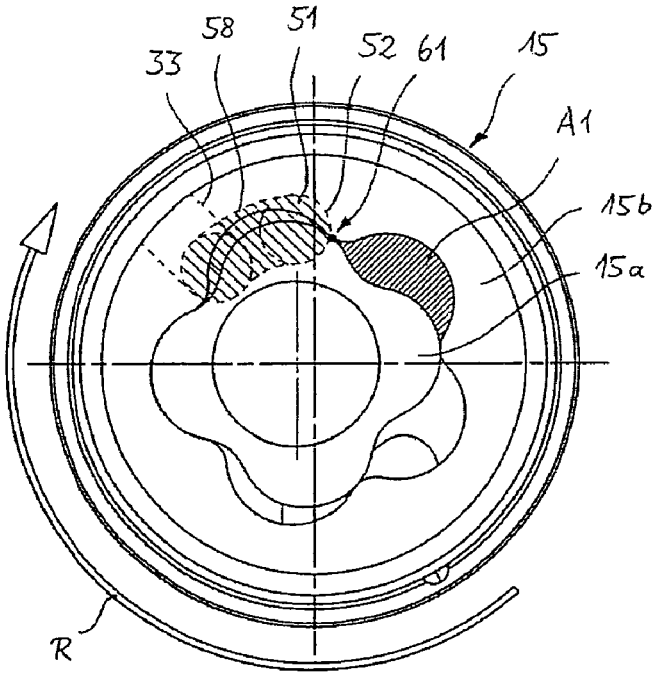

To the extent that the pin 51 is in its second operating position and frees the overflow conduit 58 in the area of the flank 60 (and/or of its projection) a filling phase of the partial work chamber A1 ends during a further rotation of the wheels 15*a*, 15*b* in the direction of arrow R on a flank 61 as shown in FIG. 5*d*. The wall of the fifth bore 52 and a prolonged contact line of the wheels 15*a*, 15*b* coincide on the flank 61 and/or its prolongation. In the position of the expansion step wheels 15*a*, 15*b* shown in FIG. 5*d* they surround a volume of the partial work chamber A1 who shaded front surface is smaller by a factor of 1.1 to 1.5, in particular 1.23 than a maximally achievable front surface between the expansion step wheels 15*a*, 15*b*.

Since the pin 51 can be actuated as a function of the pressures on the inlet side and outlet side of the expansion step unit 15, a maximal pressure gradient can be defined between inlet side and outlet side as threshold value at which a subcritical operating state is left and the pin 51 can be thrust out of its first operating position. Given an approximately constant outlet pressure and/or reference pressure on the outlet side an absolute pressure value can be determined on the inlet side and when it is exceeded the pin 51 can be pushed out of its first operating position, the overflow conduit 58 is in particular freed and a transition is made into a supercritical constant volume cycle in the expansion step unit 15.

The third expansion step/compression unit 2" described using FIGS. 4*a* to 6*b* can be used just as the other two expansion step/compression units 2, 2' in a cooling process (or heat pump circuit) in accordance with FIG. 7 for the (preferably internal) utilization of energy becoming free during the expansion of the first fluid. The technical work recovered in the expansion step unit 15 is then transmitted in accordance with the invention via a common shaft from the expansion step unit 15 and a compression step unit directly to the compression step unit 14. During this time a part of the compression work of the cooling process is preferably carried out in the compression step unit 14 and the recovered technical work is internally used in this manner. In a modified exemplary embodiment several expansion step/compression units 2" are associated with a fluid-air heat exchanger 3 via which units 2" the multistage expansion as well as a multistage compression can be realized. In a further modification optionally controllable transmission units/coupling units are provided between individual or several expansion step units as well as between associated compression units. In particular, even the special features of the three similar expansion step/compression units 2, 2', 2" can be advantageously combined with each other in a system.

Each expansion step/compression unit 2, 2', 2" is especially preferably suited for being used in a heat exchanger unit 3 of the invention according to FIGS. 1 and 2. The following process steps of a cooling process carried out with the first fluid can be realized with especially simple means and in a small space with the aid of such a heat exchanger unit 3 in accordance with the invention: cooling down, intermediate compression with inner compression, further cooling down and/or (partial) condensation, expansion with inner expansion. An especially favorable and efficient process can be operated by the recovery and internal utilization in accordance with the invention of the potential energy becoming free during the expansion. A lubrication of the expansion stage/compression unit 2, 2', 2" via a small lubricating oil component in the circulated cooling agent of 0.1% to 3.5% is especially preferable.

The suggested arrangement unites a plurality of components of a cooling machine in a common structural unit that can be used with advantage as a block with an especially small parallelepipedic casing volume in automobile construction or for other mobile applications. The machine in accordance with the invention can be used after adaptation to the thermodynamic conditions in a left-to-right or right-to-left process. While certain representative embodiments and details have been shown for purposes of illustrating the invention, it will be apparent to those skilled in the art that various changes may be made without departing from the scope of the disclosure, which is further described in the following appended claims.

What is claimed is:

1. A heat exchanger unit comprising:

a first tube element unit adapted to convey a first fluid therethrough, wherein one end of the first tube element unit is in fluid communication with an inlet connection distributor, and another end of the first tube element unit is in fluid communication with an intermediate outlet;

a second tube element unit disposed adjacent the first tube element unit and adapted to convey the first fluid therethrough, wherein one end of the second tube element unit is in fluid communication with an intermediate inlet, and another end of the second tube element unit is in fluid communication with an outlet connection distributor; and an engine machine apparatus including a compression step unit disposed adjacent an expansion step unit and adapted to convey the first fluid therethrough, wherein one end of the compression step unit is in fluid communication with the intermediate outlet and another end of the compression step unit is in fluid communication with the intermediate inlet, and wherein one end of the expansion step unit is in fluid communication with the outlet connection distributor and another end of the expansion step unit is in fluid communication with a discharge.

2. The heat exchanger unit according to claim 1, wherein a rotor/diameter slot ratio is less than 500:1.

3. The heat exchanger unit according to claim 1, wherein the compression step unit is coupled to the expansion step unit in a torque-transmitting manner.

4. The heat exchanger unit according to claim 1, wherein a profile of the expansion step unit and a profile of the compression step unit are substantially similar, the profile of the expansion step unit having a different length than the profile of the compression step unit.

5. The heat exchanger unit according to claim 1, wherein a compensation/rotor surface ratio of the expansion step unit and the compression step unit is in a range of about 20% to about 50%.

6. The heat exchanger unit according to claim 1, wherein the expansion step unit and the compression step unit are disposed in a housing, the housing having a diameter in a range of about 10% to about 90% of an axial length of the housing.

7. The heat exchanger unit according to claim 6, wherein the housing includes an insulating separating wall fixedly arranged between the compression step unit and the expansion step unit, the inner compression step wheel and the outer compression step wheel of the compression step unit and the inner expansion step wheel and the outer expansion step wheel of the expansion step unit adapted to rest in a contacting manner against the wall.

8. The heat exchanger unit according to claim 6, wherein the compression step unit and the expansion step unit include a common shaft rotatably supported inside a hollow shaft affixed to the housing.

9. The heat exchanger unit according to claim 1, wherein at least one pressure chamber communicates with the expansion step unit to form at least one control element for changing a power output of the expansion step unit.

10. The heat exchanger unit according to claim 1, wherein the expansion step unit includes a first support element having a front side adapted to contact the inner expansion step wheel and the outer expansion step wheel, and the compression step unit cooperates with a second support element which is pressed frontally against at least one of the inner compression step wheel and the outer compression step wheel.

11. The heat exchanger unit according to claim 1, wherein the expansion step unit includes a variable expansion chamber adapted for an inner expansion of the first fluid and a variable compression chamber adapted for an inner compression of the first fluid.

12. The heat exchanger unit according to claim 1, wherein each of the inner compression step wheel and the inner expansion step wheel is supported on a shaft to facilitate rotation about a first axis and cooperates with an outer cogging, and each of the outer compression step wheel and the outer expansion step wheel is adapted to surround the respective inner step wheel and cooperate with an inner cogging which engages the outer cogging, the outer step wheels supported on a housing to facilitate rotation about a spaced apart second axis.

13. A heat exchanger unit comprising:

a first tube element unit adapted to convey a first fluid therethrough, wherein one end of the first tube element unit is in fluid communication with an inlet connection distributor and another end of the first tube element unit is in fluid communication with an intermediate outlet;

a second tube element unit disposed adjacent the first tube element unit and adapted to convey the first fluid therethrough, wherein one end of the second tube element unit is in fluid communication with an intermediate inlet, and another end of the second tube element unit is in fluid communication with an outlet connection distributor; and an engine machine apparatus adapted to convey the first fluid therethrough, the engine machine apparatus further including:

an expansion step unit including an inner expansion step wheel, an outer expansion step wheel, and a first support element, the first support element including a front side adapted to contact the inner expansion step wheel and the outer expansion step wheel, wherein one end of the expansion step unit is in fluid communication with the outlet connection distributor, and another end of the expansion step unit is in fluid communication with a discharge, and wherein at least one pressure chamber communicates with the expansion step unit to form at least one control element for changing a power output of the expansion step unit, the expansion step unit also including a variable expansion chamber adapted for an inner expansion of the first fluid and a variable compression chamber adapted for an inner compression of the first fluid, and a compression step unit disposed adjacent the expansion step unit and including an inner compression step wheel and an outer compression step wheel, wherein one end of the compression step unit is in fluid communication with the intermediate outlet, and another end of the compression step unit is in fluid communication with the intermediate inlet, and wherein the compression step unit cooperates with a second support element which is pressed frontally against at least one of the inner compression step wheel and the outer compression step wheel, the second support element adapted to cooperate with the at least one control element, wherein the at least one control element is adjustable as a function of a parameter that can be varied during an operation of at least one of the expansion step unit and the compression step unit; and wherein each of the inner compression step wheel and the inner expansion step wheel is supported on a shaft to facilitate rotation about a first axis and cooperates with an outer cogging, and each of the outer compression step wheel and the outer expansion step wheel is adapted to surround the respective inner step wheel and cooperate with an inner cogging which engages the outer cogging, the outer step wheels supported on a housing to facilitate rotation about a spaced apart second axis.

14. The heat exchanger unit according to claim 13, wherein the at least one control element is adjustable as a function of at least one of a pressure in at least one of an inlet conduit and an outlet conduit of the expansion step unit, an average pressure of the expansion step unit, and a pressure in at least one of an inlet conduit and an outlet conduit of the compression step unit.

15. The heat exchanger unit according to claim 13, wherein the at least one control element varies at least one of a contact pressure between the first support element and one of the inner expansion step wheel and the outer expansion step wheel, a contact pressure between the second support element and one of the inner compression step wheel and the outer compression step wheel, and a frontal contact pressure of the first support element on the inner expansion step wheel and the outer expansion step wheel as a function of an operating level of the engine machine apparatus.

16. The heat exchanger unit according to claim 13, wherein the at least one control element exerts a contact pressure on at least one of the first support element and the second support element, the first support element adapted to transfer the contact pressure to the expansion step unit of the engine machine apparatus, and the second support element adapted to transfer the contact pressure to the compression step unit of the engine machine apparatus.

17. The heat exchanger unit according to claim 13, wherein the at least one control element is one of a pneumatic spring loaded by a pressure in at least one of an inlet conduit and an outlet conduit of the expansion step unit of the engine machine apparatus, a pneumatic spring associated with a mechanical spring, the mechanical spring under a pre-tension and connected to the control element in a substantially parallel orientation, and a movable piston and a pin adapted to be loaded on a front side with an inlet-side pressure of the expansion step unit and on a rear side with an outlet-side pressure of the expansion step unit.

18. The heat exchanger unit according to claim 13, wherein the at least one control element is between the first support element and a cover attached to a housing, the at least one control element including an annular sealing element adapted to cooperate with the first support element and the cover to surround a pressure chamber.

19. The heat exchanger unit according to claim 13, wherein the at least one control element substantially restricts an overflow conduit at least in sections in a first operating position, the overflow conduit adapted to communicate with an inlet conduit and a workspace A of the expansion step unit.

20. A heating, ventilating, and air conditioning system comprising:

a collector unit adapted to separate a first fluid;

a compressor in fluid communication with the collector unit, the compressor adapted to compress the first fluid;

a first heat exchanger unit in fluid communication with the compressor, the first heat exchanger unit including:

a first tube element unit adapted to convey the first fluid therethrough, wherein one end of the first tube element unit is in fluid communication with an inlet connection distributor and another end of the first tube element unit is in fluid communication with an intermediate outlet;

a second tube element unit disposed adjacent the first tube element unit and adapted to convey the first fluid therethrough, wherein one end of the second tube element unit is in fluid communication with an intermediate inlet, and another end of the second tube element unit is in fluid communication with an outlet connection distributor; and an engine machine apparatus adapted to convey the first fluid therethrough, the engine machine apparatus further including: an expansion step unit and a compression step unit disposed adjacent the expansion step unit, wherein the expansion step unit includes an inner expansion step wheel, an outer expansion step wheel, and a first support element, the first support element including a front side adapted to contact the inner expansion step wheel and the outer expansion step wheel, wherein one end of the expansion step unit is in fluid communication with the outlet connection distributor, and another end of the expansion step unit is in fluid communication with a discharge, and wherein at least one pressure chamber communicates with the expansion step unit to form at least one control element for changing a power output of the expansion step unit, the expansion step unit also including a variable expansion chamber adapted for an inner expansion of the first fluid and a variable compression chamber adapted for an inner compression of the first fluid, and the compression step unit including an inner compression step wheel and an outer compression step wheel, wherein one end of the compression step unit is in fluid communication with the intermediate outlet, and another end of the compression step unit is in fluid communication with the intermediate inlet, and wherein the compression step unit cooperates with a second support element which is pressed frontally against at least one of the inner compression step wheel and the outer compression step wheel, the second support element adapted to cooperate with the at least one control element, wherein each of the inner compression step wheel and the inner expansion step wheel is supported on a shaft to facilitate rotation about a first axis and cooperates with an outer cogging, and each of the outer compression step wheel and the outer expansion step wheel is adapted to surround the respective inner step wheel and cooperate with an inner cogging which engages the outer cogging, the outer step wheels supported on a housing to facilitate rotation about a spaced apart second axis; and a second heat exchanger in fluid communication with the first heat exchanger and the collector unit.

* * * * *